US006170158B1

(12) United States Patent
Daily

(10) Patent No.: US 6,170,158 B1
(45) Date of Patent: Jan. 9, 2001

(54) POCKET KNIFE

(75) Inventor: John Patrick Daily, Beverly Hills, CA (US)

(73) Assignee: Delta Z Knives, Inc., Studio City, CA (US)

( * ) Notice: Under 35 U.S.C. 154(b), the term of this patent shall be extended for 0 days.

(21) Appl. No.: 09/328,116

(22) Filed: Jun. 8, 1999

(51) Int. Cl.[7] ..... B26B 1/04
(52) U.S. Cl. ..... 30/161; 30/155; 30/342
(58) Field of Search ..... 30/157, 158, 159, 30/160, 161, 152, 342

(56) References Cited

U.S. PATENT DOCUMENTS

| | | | | |
|---|---|---|---|---|
| 304,451 | * | 9/1884 | Rauh | 30/161 |
| 338,251 | * | 3/1886 | Crandall et al. | 30/161 |
| 445,509 | * | 1/1891 | Thayer | 30/158 |
| 465,715 | | 12/1891 | Lutters | 30/160 |
| 749,230 | * | 1/1904 | Severance | 30/160 |
| 801,970 | * | 10/1905 | Connell | 30/160 |
| 847,206 | * | 3/1907 | Saunderson | 30/160 |
| 943,990 | * | 12/1909 | Nell | 30/159 |
| 1,252,486 | * | 1/1918 | Paulson | 30/161 |
| 1,701,027 | | 2/1929 | Brown | 30/159 |
| 2,530,236 | | 11/1950 | Erickson | 30/159 |
| 3,829,967 | | 8/1974 | Gilbert | 30/157 |
| 4,120,088 | | 10/1978 | Phelps | 30/160 |
| 4,218,819 | | 8/1980 | Phelps | 30/157 |
| 4,408,394 | | 10/1983 | Phelps | 30/157 |
| 4,426,779 | * | 1/1984 | Morgan | 30/158 |
| 4,501,068 | | 2/1985 | Palson | 30/157 |
| 5,060,379 | | 10/1991 | Neely | 30/161 |
| 5,125,157 | | 6/1992 | Howard | 30/157 |
| 5,293,690 | | 3/1994 | Cassady | 30/160 |
| 5,325,588 | * | 7/1994 | Rogers | 30/158 |
| 5,769,094 | * | 6/1998 | Jenkins, Jr. et al. | 30/160 |

FOREIGN PATENT DOCUMENTS

| | | | | |
|---|---|---|---|---|
| 326478 | * | 11/1902 | (FR) | 30/161 |
| 703956 | * | 2/1931 | (FR) | 30/161 |

* cited by examiner

*Primary Examiner*—Rinaldi I. Rada
*Assistant Examiner*—Omar Flores-Sánchez
(74) *Attorney, Agent, or Firm*—Roth & Goldman

(57) ABSTRACT

A foldable pocket knife constructed to look like a fine writing pen includes a quick opening blade moved about 180° from the closed to the open position by grasping a pivotally movable portion of the knife handle which moves with the blade as a unit for 180° to open the blade and then continues in its pivotable movement 360° to its original position where its functions, together with a stationary handle portion, as the handle of the knife. The knife blade is closed by moving the moveable portion of the handle in the reverse direction to engage the blade and subsequently move together with the blade as a unit back to the original position adjacent the stationary portion of the handle. Accordingly, the user's hand need not contact the blade in either the opening nor the closing movement thereof.

12 Claims, 2 Drawing Sheets

POCKET KNIFE

CROSS REFERENCE TO RELATED APPLICATIONS, IF ANY

None

BACKGROUND OF THE INVENTION AND PRIOR ART

The present invention relates generally to knives and, more particularly, to foldable pocket knives which may be camouflaged to appear as a fountain pen or ball point pen or the like. In general, foldable pocket knives include a handle having a blade cavity therein, the blade being pivotally affixed to the handle and received in the cavity which is defined between spaced handle side portions. A spring retainer is usually also affixed in the handle and moves in the general plane in which the blade pivots, to the spring bias and hold the blade in a blade deployed or stored position. A well known disadvantage of knives of this general type is the difficulty in quickly grasping and opening the blade. Usually, the blade is provided with a fingernail receiving groove being the only portion of the blade which is exposed when the blade is in its stored position. The difficulty in opening the blade is the result of the relatively large blade opening spring force which must be overcome merely by insertion of a single fingernail into the blade opening groove.

Other prior art types of knives are designed to open more quickly but are not always legal such, for example, as spring actuated switch blade knives which rely upon a spring to bias the blade to the deployed position upon actuation of a push button or the like.

OBJECT OF THE INVENTION

It is the primary object of the present invention to provide a knife which may be quickly opened and closed without the above disadvantages and without grasping the blade itself.

SUMMARY OF THE INVENTION

The present invention accordingly provides a pocket knife comprising:

a) an elongate handle body having a full handle portion and a stationary partial handle portion;

b) a moveable partial handle portion connected to said stationary partial handle portion for movement around a pivot axis proximate one end of said body, said first and second partial handle portions defining a blade storage space therebetween;

c) a blade connected to each of said partial handle portions for movement around said pivot axis proximate said one end of said body, said moveable partial handle portion being positionable alongside said stationary partial handle portion in a first position with said blade stored in said space;

d) first retainer means for releasably affixing said moveable partial handle portion to said blade as said second partial handle portion and blade are pivotally moved as a unit in a blade opening direction from said first position to a blade deployed position; and e) second retainer means for releasably affixing said blade to said body in said blade deployed position as said moveable partial handle portion is further moved in said blade opening direction to said first position alongside said stationary partial handle portion with said blade operably deployed.

As used herein, the term "full handle portion" refers to the portion of the knife handle which is not formed in part by a moveable partial handle portion.

DESCRIPTION OF THE PREFERRED EMBODIMENT

Figure 1:
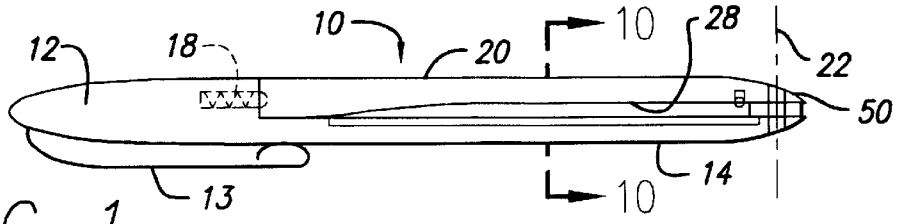
FIG. 1 is a plan view of the knife with blade closed.
Figure 2:
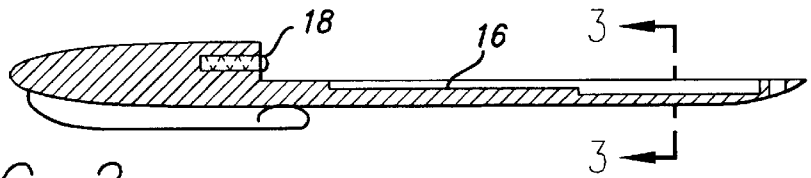
FIG. 2 is a horizontal cross-section of the handle body.
Figure 3:
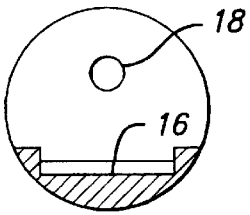
FIG. 3 is a right side elevation to an enlarged scale, partly in section, taken at line 3—3 on FIG. 2.

The knife includes an elongated body 10 having an integrally formed full handle portion 12 and a stationary partial handle portion 14 best seen in FIGS. 1 and 2 configured to look like a fine writing pen. The knife body is preferably of oval or round cross-section as best seen in FIG. 3. The knife further includes moveable handle portion 20 pivotally connected to the stationary portion 14 for movement around a pivot axis 22 proximate one end of the knife body. Accordingly, the spaced partial handle portions 14 and 20 define a storage space therebetween for receiving a single edged blade 30. The knife body 10 has an elongated recess 16 which may be stepped as shown in FIGS. 2 and 3, for a purpose to be described. Also, the knife body may be provided with a pocket clip 13 to further enhance the appearance of the article as a pen. A spring ball retainer schematically shown at 18 in the full handle portion 12 of the pen body engages a recess 27 in an end surface 26 of the moveable partial handle portion 20 to retain the moveable handle portion 20 in place alongside the stationary handle portion 12 both when the blade is in its stored position and when the blade is in its deployed or operative position.

Figure 4:
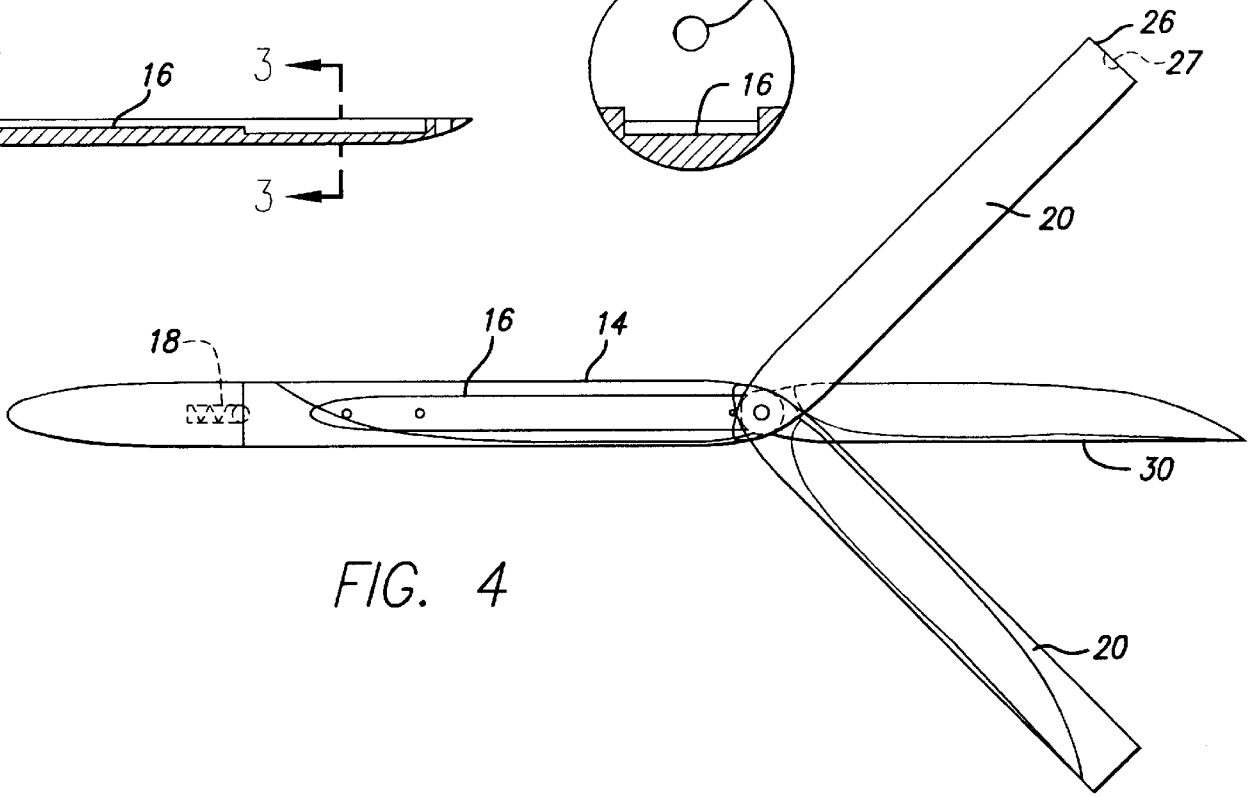
FIG. 4 is a side elevation view of the knife with the blade deployed and a moveable portion of the handle positioned intermediate the blade and the main body portion of the handle.

As seen in FIG. 4, the blade 30 and moveable handle portion 20 move together counterclockwise as a unit when opening the blade from the blade stored position through an intermediate position to a blade deployed position following which the moveable handle portion 20 continues its counterclockwise path of movement back to its original position along side the stationary partial handle portion 14.

A spring loaded ball 24 is provided at the location shown in the moveable partial handle portion 20 and engages a recess 38 in one side of the blade to releasably affix the moveable partial handle portion 20 and blade 30 together as the moveable handle portion and blade are pivotally moved as a unit in the blade opening direction until the blade reaches the blade deployed position which, as shown in FIG. 4, is in substantial alignment with the handle body 10. In effect, the blade has moved from its stored position through an angle of approximately 180° to its full open position.

Figure 5:
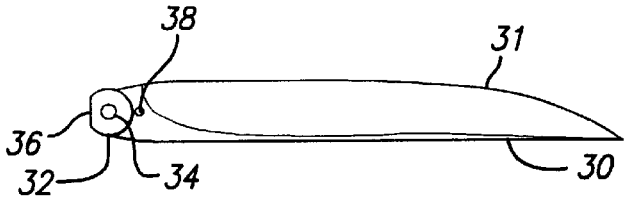
FIG. 5 is a front elevation view of the blade.
Figure 9:
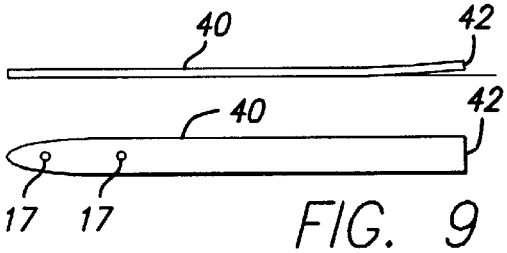
FIG. 9 is a plan view of a leaf spring liner.
Figure 10:
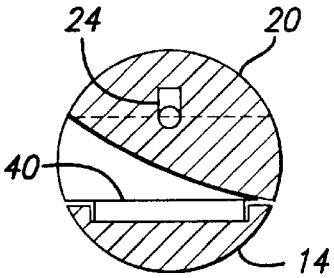
FIG. 10 is an enlarged cross-section taken at line 10—10 on FIG. 1.
Figure 11:
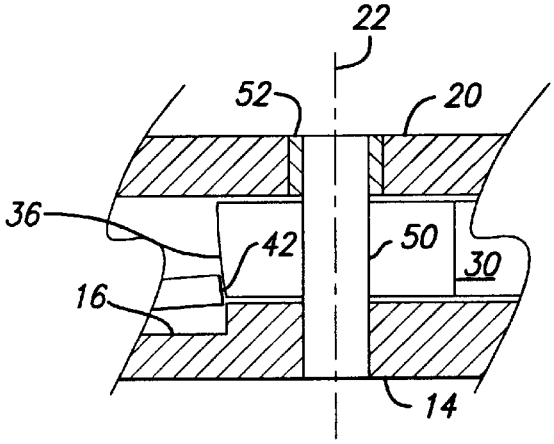
FIG. 11 is an enlarged cross-section of the blade pivot connection.

An elongated spring liner 40 as seen in FIG. 9 is fastened with a pair of rivets or other suitable fasteners 17 in the recess 16 to the stationary partial handle portion 14. The spring liner 40 is slightly bent and has a flat end 42 proximate the pivot axis 22 such that the flat end 42 is biased outwardly of the recess 16 into the space between the stationary and moveable handle portions 14, 20 as seen in FIG. 11. The blade 30 is provided with a bearing boss 32 having a bearing aperture 34 therein and a flat end 36 in the location shown in FIG. 5 and seen to an enlarged scale in FIG. 11. The flat end 36 of the blade is engageable with the flat end 42 of the spring liner 40 to retain the blade in its deployed position. Close inspection of the blade end configuration seen in FIG. 11 shows that the blade end 36 and preferably also the end 42 of the spring liner 40 are beveled in a direction to cam the end 42 of the spring in a direction generally normal to the plane of the blade 30 into the recess 16 as the blade is pivoted clockwise as sen in FIG. 4 from its operative position to its stored position.

Figure 6:
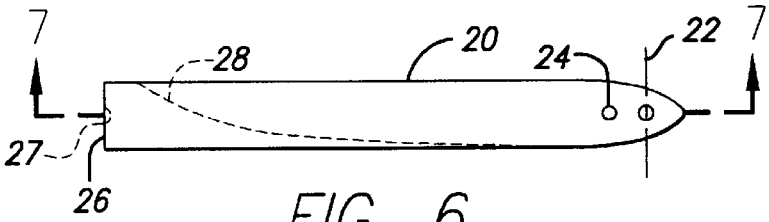
FIG. 6 is a front elevation view of the moveable portion of the handle.
Figure 7:
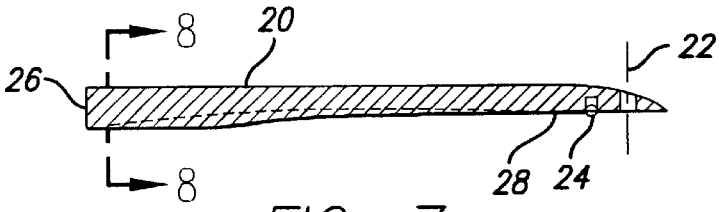
FIG. 7 is a cross-section of the moveable portion of the handle taken at line 7—7 on FIG. 6.
Figure 8:
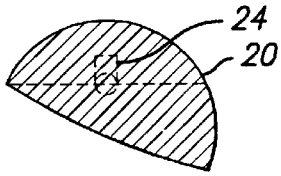
FIG. 8 is a cross-section taken at line 8—8 on FIG. 7.

Preferably, the cutting edge 31 of the blade 30 is arranged to face the direction of pivotal movement of the blade during movement of the blade in the blade opening direction. In the configuration shown in FIG. 4, the knife may be considered a right-handed knife in which the blade is moved in a counter-clockwise direction relative to the handle as it is opened. It will be appreciated by persons skilled in the art that a left-handed blade configuration can also be designed in which the blade is arranged with its cutting edge 31 in the opposite direction if desired. As seen in FIG. 6, a recess 28 is preferably provided in the moveable handle portion 20 to receive and contain the blade 30. A side surface of the recess 28 engages the side surface and/or the sharpened edge of the blade to prevent the blade from pivotally moving in the blade opening direction past the moveable partial handle portion 20 as the moveable handle portion 20 and blade 30 are moved together as a unit in opening the blade. Continued movement of the moveable partial handle portion 20 counterclockwise beyond the 180° position at which the blade is fully deployed uncovers the blade as the moveable partial handle portion 20 continues in a 360° rotation back to its original position adjacent the stationary partial handle portion 14.

Closing of the blade involves movement of the moveable partial handle portion 20 in the reverse direction (clockwise as shown in FIG. 4) to the 180° position at which it first engages the blade 30 and subsequently moves with the blade back through 360° to its original location adjacent the stationary partial handle portion 14, the blade 30 being contained in the space between the partial handle portions 14 and 20.

The pivotal connection between the stationary portion 14 of the handle, the moveable portion 20 of the handle and the blade 30 about the pivot axis 22 can be accomplished in any suitable manner. Preferably, a single pivot pin 50 is non-rotatably affixed to the stationary partial handle portion 14 and extends through the bearing aperture 34 in the blade 30 and is received in a suitable bearing 52 affixed to the moveable partial blade portion 20.

The overall size of the knife (configured to look like a pen) should be in the range of about 5" to 5.5" with a circular cross-section having a diameter of approximately 0.50" to 0.65". The knife body may be finished to look like a fine writing pen such, for example, by being constructed of 6061-T6 aluminum anodized black or dark blue. The blade should preferably be at least 3" in length and may be, constructed of ATS34 stainless steel having a bright finish. The spring liner is preferably made of titanium and the pocket clip may be made of titanium with an anodized gold finish.

Persons skilled in the art will readily appreciate that various additional modifications can be made from the presently preferred embodiment thus the scope of protection is intended to be defined only by the limitations of the appended claims.

What is claimed is:

1. A pocket knife comprising;

a) an elongate handle body having a full handle portion and a stationary partial handle portion;

b) a moveable partial handle portion connected to said stationary partial handle portion for movement around a pivot axis proximate one end of said elongate blade body, said partial handle portions defining a blade storage space therebetween;

c) a blade connected to each of said partial handle portions for movement around said pivot axis proximate said one end of said elongate handle body, said blade having a single cutting edge, said cutting edge facing the direction of pivotal movement of said blade during movement of said blade in said blade opening direction, said moveable partial handle portion being positionable alongside said stationary partial handle portion in a first position with said blade stored in said space, said moveable partial handle portion having a recess therein configured to receive said blade, said recess having a side surface which abuts said cutting edge of said blade to prevent said blade from pivotally moving past said moveable partial handle portion when said moveable partial handle portion is moved toward said cutting edge of said blade;

d) first retainer means for retaining said moveable partial handle portion along side said blade as said moveable partial handle portion and blade are pivotally moved as a unit in a blade opening direction from said first position to a blade deployed position, said first retainer means comprising a spring loaded ball positioned to partially extend from a side surface of said moveable partial handle portion and a recess in a side surface of said blade; and e) second retainer means for affixing said blade to said body and holding said blade in deployed position as said moveable partial handle portion is further moved in said blade opening direction to said first position alongside said stationary partial handle portion with said blade operably deployed.

2. The pocket knife of claim 1, wherein said second retainer means includes a spring liner affixed to said stationary partial handle portion of said body in said space, said liner having a flat end proximate said pivot axis, and said blade having a flat end proximate said pivot axis, said flat end of said blade being engageable with said flat end of said liner to retain said blade in said deployed position.

3. The pocket knife of claim 2, further comprising an elongated recess in said stationary partial handle portion, said liner comprising an elongated leaf spring seated in said elongated recess and fastened at one end of said elongated recess to said stationary partial handle portion, said flat end of said spring extending from said recess toward said blade to engage said flat end of said blade when said blade is deployed in operative position, at least one of said flat ends of said blade and spring being beveled in a direction to cam said end of said spring in a direction generally normal to the plane of said blade into said recess as said blade is pivoted from said operative position to said stored position.

4. The pocket knife of claim 3, wherein said liner is titanium.

5. The pocket knife of claim 1, further comprising third retainer means for releasably affixing said moveable partial handle portion to said handle body.

6. The pocket knife of claim 5, wherein said third retainer means comprises a spring loaded ball in said full handle portion of said body and a recess in said moveable partial handle portion.

7. The pocket knife of claim 1, wherein said blade has a single cutting edge, said cutting edge facing the direction of pivotal movement of said blade during movement of said blade in said blade opening direction.

8. The pocket knife of claim 7, wherein said blade is ATS 34 stainless steel.

9. The pocket knife of claim 1, wherein said stationary and moveable partial handle portions are have a substantially similar cross sectional shape.

10. The pocket knife of claim 9, wherein said body is configured to look like a pen and further comprising a pocket clip affixed to said full handle portion of said body.

11. A pocket knife comprising:

a) an elongate handle body having a full handle portion and a stationary partial handle portion;

b) a moveable partial handle portion connected to said stationary partial handle portion for movement around a pivot axis proximate one end of said elongate handle body, said partial handle portions defining a blade storage space therebetween;

c) a blade connected to each of said partial handle portions for movement around said pivot axis proximate said one end of said elongate handle body, said blade having a single cutting edge, said cutting edge facing the direction of pivotal movement of said blade during movement of said blade in said blade opening direction, said moveable partial handle portion being positionable alongside said stationary partial handle portion in a first position with said blade stored in said space, said moveable handle portion having a recess therein configured to receive said blade, said recess having a surface which engages said cutting edge of said blade to prevent said moveable partial handle portion from pivotally moving past said blade and to close said blade when said moveable partial handle portion is pivotally moved in a blade closing direction opposite to said blade opening direction;

d) first retainer mean for retaining said moveable partial handle portion alongside said blade as said moveable partial handle portion and blade are pivotally moved as a unit in a blade opening direction from said first position to a blade deployed position;

e) second retainer means for affixing said blade to said body and holding said blade in deployed position as said moveable partial handle portion is further moved in said blade opening direction to said first position alongside said stationary partial handle portion with said blade operably deployed; and f) third retainer means comprising a spring loaded ball in said full handle portion of said body and a recess in said moveable partial handle portion for affixing said moveable partial handle portion to said handle body and wherein said spring loaded ball is moveable in substantially the elongate direction of said body and said recess is in an end surface of said moveable partial handle portion.

12. The pocket knife of claim 11, wherein said blade and said moveable partial handle portion are pivotally moveable with respect to said body approximately 180° during movement from said storage portion to said blade deployed position.

* * * * *